US005414323A

United States Patent [19]

Uchida et al.

[11] Patent Number: 5,414,323

[45] Date of Patent: May 9, 1995

[54] IN-LINE TYPE ELECTRON GUN ASSEMBLY INCLUDING ELECTRODE UNITS HAVING ELECTRON BEAM PASSAGE HOLES OF DIFFERENT SIZES FOR FORMING AN ELECTROSTATIC LENS

[75] Inventors: Go Uchida; Shoji Shirai, both of Mobara; Masayoshi Misono, Chiba, all of Japan

[73] Assignee: Hitachi, Ltd., Tokyo, Japan

[21] Appl. No.: 984,332

[22] Filed: Dec. 2, 1992

[30] Foreign Application Priority Data

Dec. 2, 1991 [JP] Japan ..... 3-341785

[51] Int. Cl.[6] ..... H01J 29/62

[52] U.S. Cl. ..... 313/414; 313/458

[58] Field of Search ..... 313/412, 414, 428, 432, 313/439, 452, 458; 315/15, 382, 368.15

[56] References Cited

U.S. PATENT DOCUMENTS 4,581,560 4/1986 Shirai et al. ..... 313/414
4,766,344 8/1988 Say ..... 313/414
5,146,733 9/1992 Shirai et al. ..... 313/412 X

FOREIGN PATENT DOCUMENTS 126486 11/1984 European Pat. Off. .
134059 3/1985 European Pat. Off. .

*Primary Examiner*—Donald J. Yusko
*Assistant Examiner*—Ashok Patel
*Attorney, Agent, or Firm*—Antonelli, Terry, Stout & Kraus

[57] ABSTRACT

An in-line type electron gun assembly has a cathode unit for producing a central electron beam and two side electron beams and first and second electrode units. Each of the first and second electrode units has a cylindrical member of a non-circular elongated cross section and a plate member provided on the inner wall of the cylindrical member so as to be joined therewith to define three electron beam passage holes juxtaposed, within the cylindrical member, in a direction parallel with a lengthwise direction of the elongated cross section of the cylindrical member. The plate member of each electrode unit has at least one hole therein serving as an electron beam passage hole for the central electron beam. The diameter of the hole in one of the plate members of the first and second electrode units measured in a direction perpendicular to the lengthwise direction of the elongated cross section of the cylindrical members is different from the diameter of the corresponding hole in the other plate member measured in a direction perpendicular to the lengthwise direction of the elongated cross section of the cylindrical members for optimizing the central electron beam shape and for emphasizing one of a focusing and diverging function.

16 Claims, 6 Drawing Sheets

IN-LINE TYPE ELECTRON GUN ASSEMBLY INCLUDING ELECTRODE UNITS HAVING ELECTRON BEAM PASSAGE HOLES OF DIFFERENT SIZES FOR FORMING AN ELECTROSTATIC LENS

BACKGROUND OF THE INVENTION

This invention relates to a cathode-ray tube for use in color image display. More in particular, in an in-line type electron gun assembly for arranging and emitting three electron beams in a lateral direction toward a fluorescent screen or a phosphor screen, the present invention relates to an improvement in the shapes of electron beam passage holes in a plurality of electrode units constituting an electrostatic lens or an electron lens.

Conventionally, an in-line type electron gun assembly equipped with a main electron lens employs the structure described, for example, in JP-A-58-103752 (corresponding to U.S. patent Specification No. 4,581,560 assigned to the assignee of the present invention and issued on Apr. 8, 1986).

FIGS. 1*a*, 1*b* and 1*c* are structural views showing a schematic structure of the in-line type electron gun assembly equivalent to the one described in the reference. FIG. 1*a* is a longitudinal sectional view in a vertical direction, FIG. 1*b* is a transverse sectional view taken along a line 1*b*—1*b* in FIG. 1*a* in a horizontal direction, and FIG. 1*c* is a transverse sectional view taken along a line 1*c*—1*c* in FIG. 1*a* in a horizontal direction.

In FIG. 1*a*, reference numeral 41 denotes a cathode for generating three electron beams; 42 a G1 electrode for limiting the diameters of the electron beams emitted from the cathode 41; 43 a G2 electrode for accelerating the electron beams from the G1 electrode 42; and 43 a cylindrical G3 electrode for accelerating and converging the electron beams from the G2 electrode 43, having an aperture of a substantially elliptic cross section. A plate member 46 is disposed on the inner wall of a cylindrical member of the G3 electrode 44, and another plate member is disposed on the inner wall of a cylindrical member of the G4 electrode 45.

The G3 electrode 44 equipped with the plate member 46 and the G4 electrode equipped with the plate member 47 together constitute the main electron lens. Three, substantially elliptic electron beam passage holes are formed in each of the plate members 46 and 47 of the G3 and G4 electrodes, respectively, as shown in FIGS. 1*b* and 1*c*. These three substantially elliptic electron beam passage holes are so constituted that the diameter (the major diameter) in their lengthwise direction is equal to one another.

The in-line type electron gun having such a construction operates in the following way.

Thermoelectrons emitted from the three cathodes 41 heated by a heater (not shown) are attracted to the G1 electrode 42 by a positive voltage applied to the G2 electrode 43 and form three electron beams. These three electron beams pass through the electron beam passage holes of the G1 electrode 42 and then through the electron beam passage holes of the G2 electrode 43 and thereafter enter the main electron lens constituted by the electrodes 44 and 45 while being accelerated by the positive voltages applied to the G3 and G4 electrodes 44 and 45. A low voltage of from about 5 to about 10 KV is supplied to the cylindrical member 44 of the G3 electrode and to its plate member 46, while a high voltage of from about 20 to about 35 KV is applied to the cylindrical member of the G4 electrode 45 and to its plate member 47. Accordingly, an electrostatic field is generated between the G3 electrode 44 and the G4 electrode 45 due to the difference of the impressed potentials between the G3 electrode 44 and the G4 electrode 45. The trajectories of the three electron beams supplied to the main electron lens are bent by this electrostatic field and eventually, the three electron beams are converged. In this way, a focus is formed on the phosphor screen (not shown) and a beam spot is formed on the screen.

In the conventional in-line type electron gun assembly described above, the cylindrical members of the G3 and G4 electrodes 44, 45 generally have a substantially elliptic cross section of the aperture. When the G3 and G4 electrodes 44, 45 equipped with the cylindrical members having such a substantially elliptic cross section of the aperture are used, however, the major diameter (a diameter in the lateral direction or in a horizontal direction in the drawing) is considerably greater than the minor diameter (a diameter in a longitudinal direction or in a vertical direction in the drawing). For this reason, if the electron beam passage holes formed in the plate members of the electrodes 44 and 45 are found, focusing effects of the three electron beams are different between the vertical direction and the horizontal direction, and the spot shapes on the phosphor screen are expanded in the horizontal direction.

To solve this problem, it has been a customary practice to shape the shapes of the electron beam passage holes disposed in the plate members 46, 47 of the G3 and G4 electrodes into a substantially elliptic shape as in the in-line type electron gun described in the prior art reference, and moreover, to shape the elliptic shape into a longitudinally elongated shape in the vertical direction, contrary to the cross sectional shape of the apertures of the cylindrical members of the G3 and G4 electrodes 44, 45.

According to this structure, the three electron beams that would otherwise tend to expand in the horizontal direction due to the elliptic cross section of the apertures are much more focused in the horizontal direction than in the vertical direction at the portions of the substantially elliptic electron beam passage holes of the plate members 46, 47 of the G3 and G4 electrodes. Accordingly, the section of the three electron beams after passing through the main electron lens becomes generally round and the tendency of the spot shape on the phosphor screen to expand in the horizontal direction is much suppressed.

SUMMARY OF THE INVENTION

However, the diameter of the neck portion of a glass envelope of an in-line type color cathode-ray tube within which an electron gun assembly is placed is getting smaller and smaller for the purpose of minimizing electric power for deflecting the electron beams from the viewpoint of economy of energy, lowering of power consumption, etc. in the recent color TV, the monitoring display device in terminal apparatuses and so forth to which the in-line type electron gun assembly is employed. This fact surely restricts the above-mentioned measure of increasing the vertical direction diameter of the electron beam passage holes in the plate members to make the shape vertically elongated and, therefore, the cross-section of the electron beams in the above-mentioned reference may not be satisfactory. Particularly when the in-line type electron gun assembly is employed in a color-cathode ray tube used as a monitoring display device of terminal apparatuses which require high definition image quality, it is required that the resolution of the color-cathode ray tube is higher because of the still existing expansion of the beam spot shape in the horizontal extension on the screen.

To cope with this requirement to increase the resolution, it may be considered that the horizontal direction diameter is further decreased to increase the ratio of the vertical direction diameter to the horizontal direction diameter of the electron beam passage holes in the plate member of the G3 electrode. However, such a structure of the electrode will bring about another problem in that the electron beams tend to impinge on the plate member of the G3 electrode. Particularly, the center electron beam impinges on the plate member of the G3 electrode to cause an unwanted current in the G3 electrode (having a function of focusing the beam) forming a main electrostatic lens to bring about undesirable fluctuation of the potential of that electrode. This may make the focusing adjustment unsatisfactory, which causes the image on the screen dull and flickering to degrade the image quality.

Furthermore, the impingement of the electron beams on the plate member of the G3 electrode may cause the electrode to be undesirably heated to be deformed or burnt, which lowers the reliability of the cathode-ray tube.

It is an object of the present invention to provide an in-line type electron gun assembly which makes focusing effects for electron beams substantially uniform in each direction, and which stabilizes potentials of electrode units of the electron gun assembly.

It is another object of the present invention to provide a color cathode-ray tube equipped with such an electron gun assembly.

According to one aspect of the present invention, an in-line type electron gun assembly includes a cathode unit for producing three electron beams, and a cylindrical electrode unit on a low potential side and a cylindrical electrode unit on a high potential side downstream of the former with respect to the electron beams, each of the electrode units having a non-circular elongated cross section having a smaller diameter in a vertical direction than in a horizontal direction which orthogonally crosses the vertical direction and is a direction of the arrangement of the electron beams, wherein each of the electrode units includes a cylindrical member and a plate member disposed on the inner wall of the cylindrical member and having at least a non-circular electron beam passage hole for the central electron beam of the three electron beams formed thereon, both of the electrode units together constitute an electron lens, and the diameters of the central electron beam passage holes of the plate members of both electrode units are mutually different in the vertical direction.

The mutual relationship between the diameter of the non-circular central electron beam passage hole in the vertical direction, of the electrode unit on the low potential side (hereinafter referred to as the "former") and the diameter of the non-circular central electron beam passage hole of the plate member of the electrode unit on the high potential side in the vertical direction (hereinafter referred to as the "latter") provides the following effects.

(a) When the former is longer than the latter

In this case, the diameter, in the vertical direction, of the non-circular electron beam passage hole of the plate member of the electrode unit on the low potential side having the beam converging function is greater than the diameter, in the vertical direction, of the non-circular electron beam passage hole of the plate member of the electrode unit on the high potential side having the beam scattering function. Therefore, the radius of curvature, in the vertical direction, on the diverging side of the electron lens becomes greater than the radius of curvature, in the vertical direction, on the converging or focusing side, so that the diverging characteristics of the electron lens in the vertical direction can be reinforced. When the central electron beam is allowed to be incident into this electron lens, the focusing effect of the electron beams in the vertical direction is weaker than that of the electron lens of the prior art structure. If the electron lens having the construction described above is used when the spot shape obtained by the central electron beam by the use of the conventional electron lens expands in the horizontal direction, the focusing effects in the vertical direction and in the horizontal direction can be aligned, and the spot shape obtained by the central electron beam can be corrected into a substantially circular shape.

(b) When the latter is shorter than the latter

In this case, the diameter, in the vertical direction, of the non-circular electron beam passage hole of the plate member of the electrode unit on the high potential side having the beam diverging function is greater than the diameter, in the vertical direction, of the plate member of the electrode unit on the low potential side having the beam converging or focusing function. Therefore, the radius of curvature, in the vertical direction, of the electron lens on the focusing side becomes greater than the radius of curvature on the diverging side, so that the focusing characteristics of the electron lens in the vertical direction can be reinforced. When the central electron beam is allowed to be incident into the electron lens, the focusing effect, in the vertical direction, of the electron beam is higher than that of the electron lens of the prior art structure. If this electron lens is used when the spot shape obtained by the central electron beam by the use of the electron lens of the prior art structure expands in the vertical direction, the focusing effects can be aligned in the vertical direction and the horizontal direction, and the spot shape obtained by the central electron beam can be corrected into a substantially circular shape, in the same way as in the case of (a) described above.

According to another aspect of the present invention, an in-line type electron gun assembly has a cathode unit for producing a central electron beam and two side electron beams and first and second electrode units which are to be held at first and second voltage in operation and through which the electron beams are to pass. The second electrode unit is downstream of the first electrode unit with respect to the electron beams. Each of the first and second electrode units has a cylindrical member of a non-circular elongated cross section and a plate member provided on an inner wall of the cylindrical member so as to be joined therewith to define three electron beam passage holes juxtaposed, within the cylindrical member in a direction parallel with a lengthwise direction of the non-circular elongated cross section of the cylindrical member. Each of the plate members has at least one hole therein serving as an electron beam passage hole for the central electron beam. The second voltage is higher than the first voltage so that the first and second electrode units cooperate to form a main electrostatic lens having a combination of a first function of the first electrode unit of causing the electron beams to focus and a second function of the second electrode unit of causing the electron beams to diverge. The diameter of the hole in the plate member of one of the first and second electrode units measured in a direction substantially perpendicular to the lengthwise direction of the non-circular elongated cross section of the cylindrical member of the one electrode unit is different from the diameter of the hole in the plate member of the other electrode unit measured in a direction substantially perpendicular to the lengthwise direction of the non-circular elongated cross section of the cylindrical members, the difference being such that one of the first and second functions is emphasized as compared with the other function in the direction substantially perpendicular to the lengthwise direction of the non-circular elongated cross section of the cylindrical members.

DESCRIPTION OF THE PREFERRED EMBODIMENTS

Figure 2:
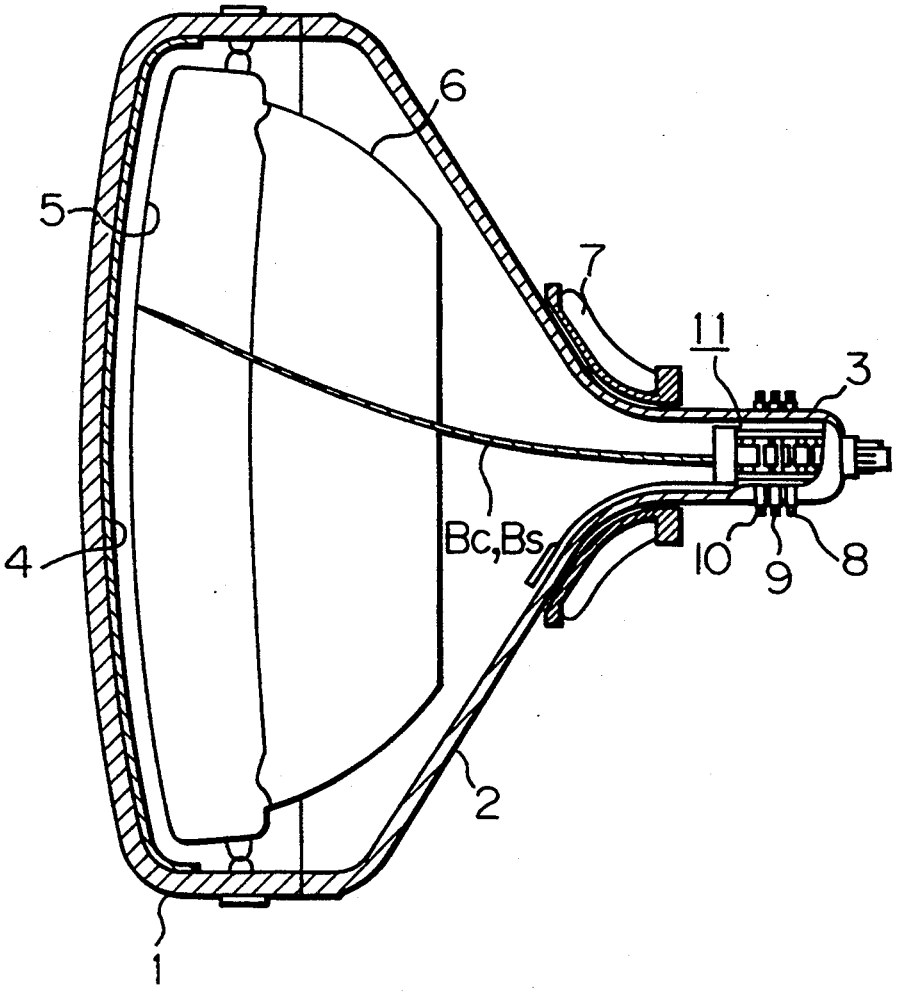
FIG. 2 is a schematic structural view showing a color cathode-ray tube equipped with an in-line type electron gun assembly according to an embodiment of the present invention.

FIG. 2 is a schematic structural view showing a color cathode-ray tube including an in-line type electron gun assembly according to an embodiment of the present invention.

In FIG. 2, reference numeral 1 denotes a panel portion, 2 a funnel portion, 3 a neck portion, 4 a phosphor screen, 5 a shadow mask, 6 a magnetic shield, 7 a deflection yoke, 8 a purity adjustment magnet, 9 a center beam static convergence adjustment magnet, 10 a side beam static convergence adjustment magnet, and 11 an in-line type electron gun assembly. Symbols Bc and Bs stand for a center beam and side beams, respectively.

Convergence adjustment (static convergence) of such a color cathode-ray tube is effected by first establishing convergence of two side beams and then bringing the convergence point of the center beam into conformity with that of the side beams.

A thin film containing $SnO_2$, $In_2O_3$, etc, for preventing reflection and charge is deposited in a single or a plurality of layers on the outer surface of the panel 1, whenever necessary. An inner conductor film made of graphite, etc. is deposited on the inner surfaces of the funnel and neck portions 2, 3, though they are not shown in the drawing. In addition to graphite, titanium dioxide is added to the conductor film so as to suppress arc and to limit its resistance value. This conductor film electrically connects a high voltage terminal (not shown) to the electron gun assembly 11.

Figure 3A:
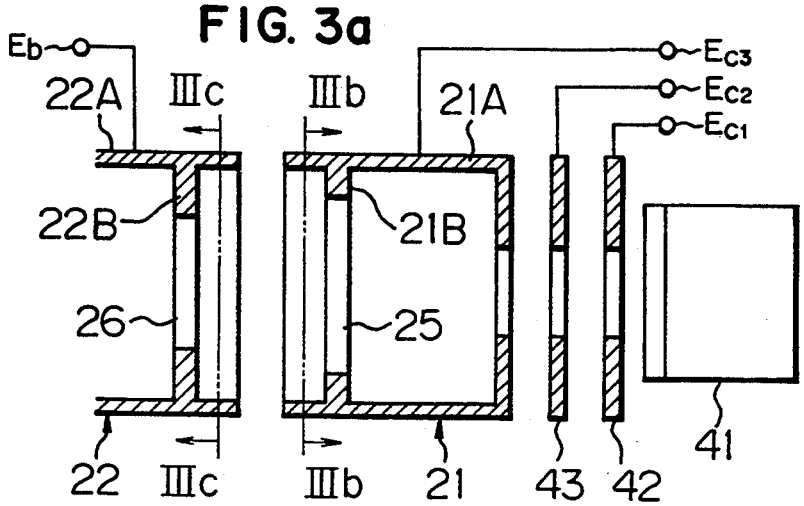
FIGS. 3*a* to 3*d* are structural sectional views showing a main electron lens portion of the in-line type electron gun assembly according to an embodiment of the present invention.
Figure 3B:
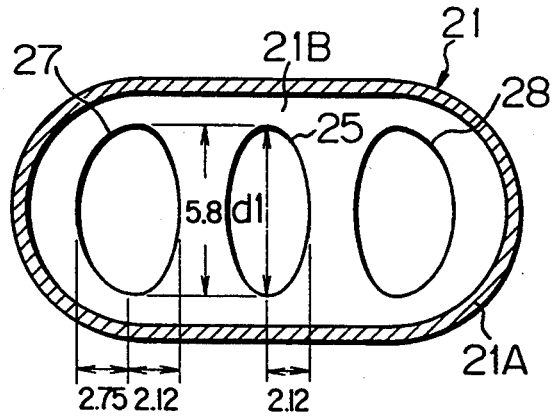
Figure 3D:
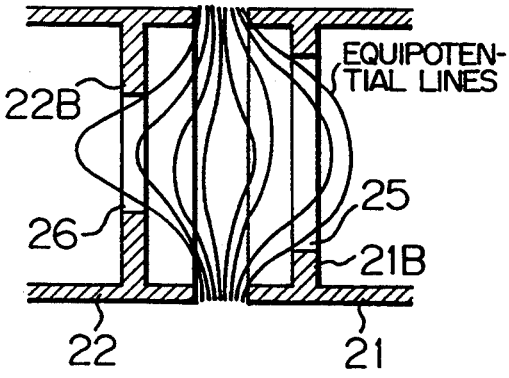
Figure 3C:
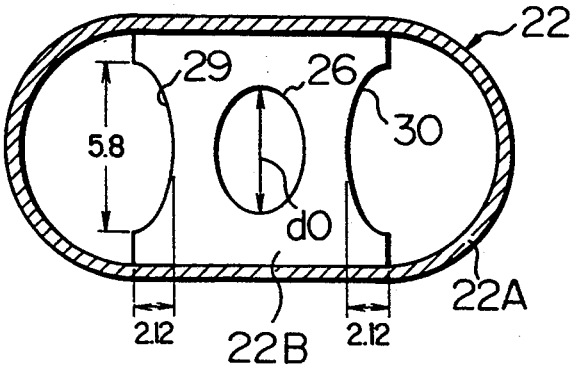

FIG. 3*a* is a vertical longitudinal sectional view showing the structure/arrangement of electrode units constituting an electron lens portion of the in-line type electron gun assembly according to an embodiment of the present invention, and FIG. 3*b* is a horizontal sectional view of the aperture of the electrode unit 21 taken along a line IIIb—IIIb of FIG. 3*a*. FIG. 3*c* is a horizontal sectional view of the electrode unit 22 taken along a line IIIc—IIIc of FIG. 3*a*, and FIG. 3*d* is an operation explanatory view showing an equipotential line inside the electrode units 21, 22 forming the electron lens.

Figure 1A:
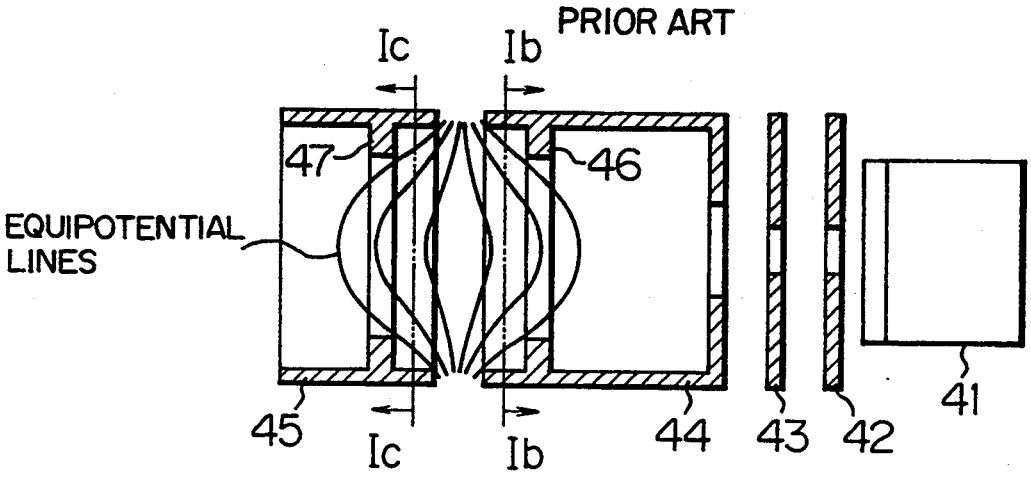
FIG. 1a PRIOR ART
FIGS. 1*a* to 1*c* are structural sectional views showing an example of a main electron lens portion of a conventional in-line type electron gun.
Figure 1B:
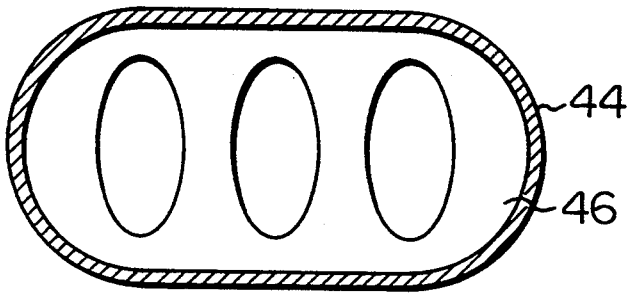
FIG. 1b PRIOR ART
Figure 1C:
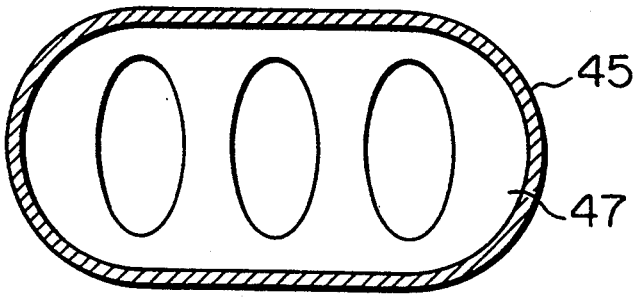
FIG. 1c PRIOR ART

In FIGS. 3*a* to 3*d*, reference numeral 21 denotes the G3 electrode unit including a cylindrical member 21A having a non-circular elongated cross section of the aperture, e.g. elliptic cross section; 22 the G4 electrode unit including a cylindrical member 22A having a non-circular elongated cross section of the aperture, e.g. substantially elliptic cross section; 21B a plate member disposed on an inner wall of the cylindrical member 21A; 22B a plate member disposed on an inner wall of the cylindrical member 22A; 25 a central electron beam passage hole of the plate member 21B; 26 a central electron beam passage hole of the plate member 22B; 27 and 28 both side electron beam passage holes of the plate member 21B; and 29 and 30 recessed edge portions disposed on the plate member 22B so as to define, in cooperation with the inner wall of the cylindrical member 22A, the side electron beam passage holes. The recessed edge portions are cutout portions, for example. Members 41 to 43 are those members which are similar to those shown in FIG. 1*a*.

The G3 electrode unit 21 and the G4 electrode unit 22, which is positioned downstream of the G3 electrode with respect to the electron beams, are arranged in such a manner that the direction of the major axis of their substantially elliptic aperture is in conformity with the horizontal direction. A low voltage of from about 5 to about 10 KV is applied to the G3 electrode unit 21 via voltage source terminal $E_{c3}$ and a high voltage of from about 20 to about 35 KV is applied to the G4 electrode unit 22 via a voltage source terminal $E_b$. The G3 electrode unit 21, the G4 electrode unit 22, the plate member 21B inside the electrode unit 21 and the plate member inside the electrode unit 22 constitute the electron lens. The central electron beam passage hole 25 of the plate member 21B and the central electron beam passage hole 26 of the plate member 22B are substantially elliptic and the direction of their major axes is in conformity with the vertical direction. Furthermore, the vertical dimension d1 of the central electron beam passage hole 25 of the plate member 21B and the vertical dimension d0 of the central electron beam passage hole of the plate member 22B satisfy the relation $d1 > d0$. The side electron beam passage holes 27, 28 of the plate member 21B has a shape obtained by cutting and connecting a half-ellipse halved and cut in the vertical direction and a semi-circle having the same diameter as the vertical dimension. The side electron beam passage cutout portions 29, 30 have a shape obtained by halving and cutting an ellipse in the vertical direction. To the G2 electrode 43 and G1 electrode 42 are applied voltages from about 500 to 600V and 0V via voltage source terminals $E_{c2}$ and $E_{c1}$, respectively.

In the construction described above, the central electron beam emitted from a cathode unit 41 passes through a G1 electrode unit 42 and a G2 electrode unit 43 and is incident into the G3 electrode unit 21. In this instance, the vertical dimension d0 of the substantially elliptic central electron beam passage hole 26 of the plate member 22B of the G4 electrode unit 22 is set to be smaller than the vertical dimension d1 of the central electron beam passage hole 25 of the plate member 21B inside the G3 electrode unit 21 in the electron lens. Furthermore, the equipotential lines in the electron lens are shown in FIG. 3*d* and is different from those shown in FIG. 1*a*. The radius of curvature of the electron lens in the vertical direction on the scattering side is smaller than that in the converging side. In other words, the beam scattering or diverging function of the electrode unit 22 in the vertical direction is much more emphasized than the beam converging or focusing function of the electrode unit 21 in the vertical direction, and the focusing effect in the vertical direction on the central electron beam is weakened.

Figure 6:
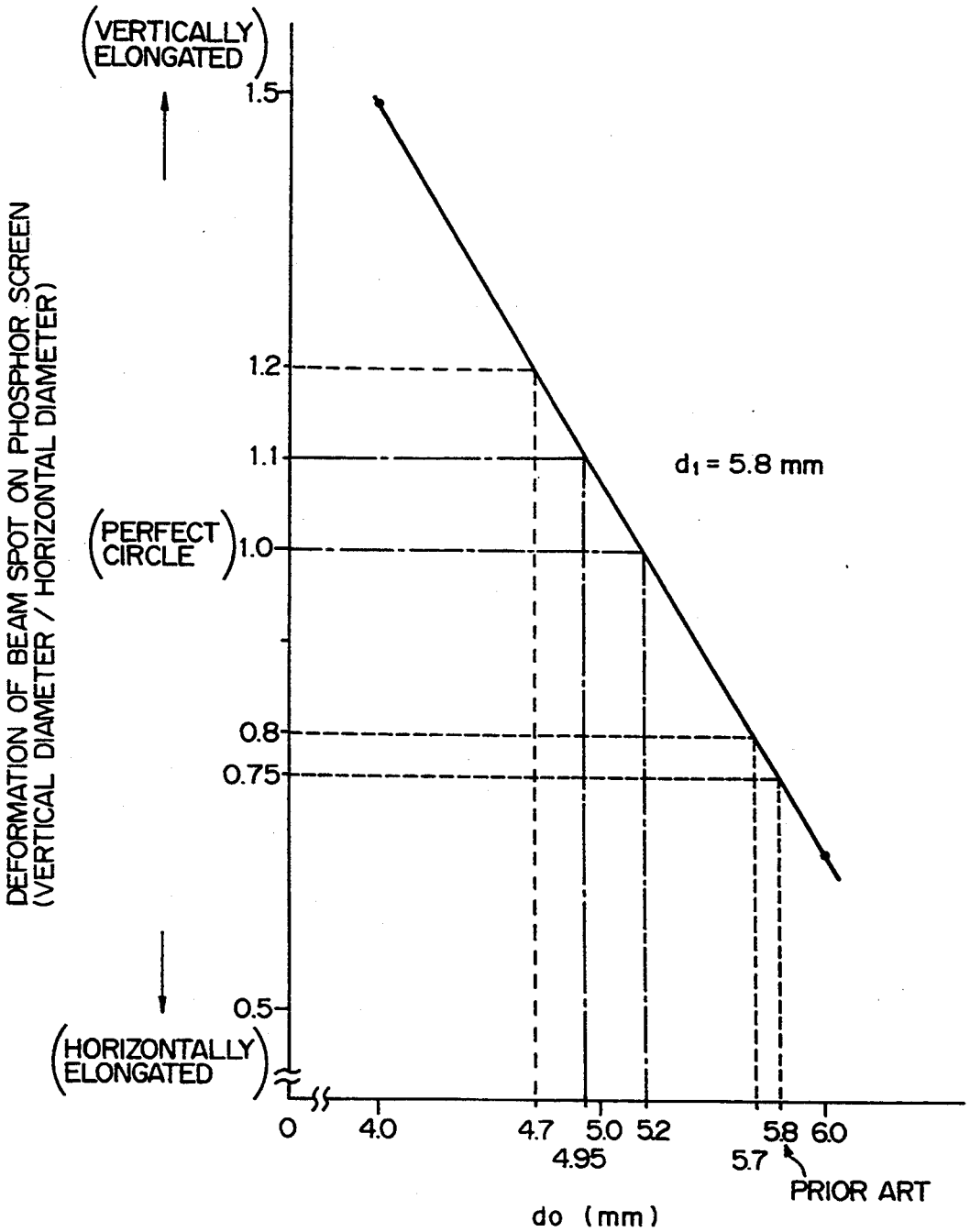
FIG. 6 is a graph showing a relation between electron beam passage holes and deformation of the electron beam spot on the phosphor screen of a cathode-ray tube having an in-line type electron gun assembly according to an embodiment of the present invention.

FIG. 6 shows a relation between the vertical direction diameter d0 of the central electron beam passage hole 26 in the G4 electrode unit 22 and deformation (vertical direction diameter/horidirection diameter) of the electron beam spot on the phosphor screen, when the central electron beam passage hole 25 in the G3 electrode unit 21 has its vertical direction diameter d1 equal to 5.8 mm, using an electron gun assembly such as shown in FIGS. 3*a* to 3*d*.

It is seen from FIG. 6 that the beam spot will be a perfect circle with the diameter d0=5.2 mm, i.e., d0/d1 ratio=0.897. According to the inventors' investigation, when the deformation of the electron beam spot assumes a value far greater than 1.2, the electron beam spot will be so elongated in the vertical direction that the focussing effect for the electron beam in the vertical direction (vertical resolution) will be degraded. On the other hand, when the deformation of the electron beam spot assumes a value far smaller than 0.8, the electron beam spot will be so elongated in the horizontal direction that the focussing effect for the electron beam in the horizontal direction (vertical resolution) will be degraded. Thus, the d0/d1 ratio should be $0.81<d0/d1<0.98$.

Preferably, the deformation of the electron beam spot should assume a value substantially in a range between 1.0 and 1.1 from the viewpoint of the practical manufacturing of electron gun assemblies. In this case the d0/d1 ratio will be $0.85<d0/d1<0.90$. When the deformation of the electron beam spot is outside of this range, halo may take place in the peripheral portion of the screen and the focusing may not be uniform all over the screen, which may somewhat lower the image quality of a color picture tube having the electron gun essembly, although such can be corrected by use of a dynamic focusing circuit.

The above description with reference to FIG. 3 is applicable to electron gun assemblies in which the electron beam passage holes have other sizes.

Therefore, in the in-line type electron gun assembly having the electron lens of the prior art structure, if the main electron lens of this embodiment is used when the spot shape obtained by the central electron beam is likely to expand in the horizontal direction, the focusing effect in the vertical direction can be made substantially equal to the focusing effect in the horizontal direction, and the spot shape obtained by the central electron beam can be corrected to a substantially circular shape.

Figure 4A:
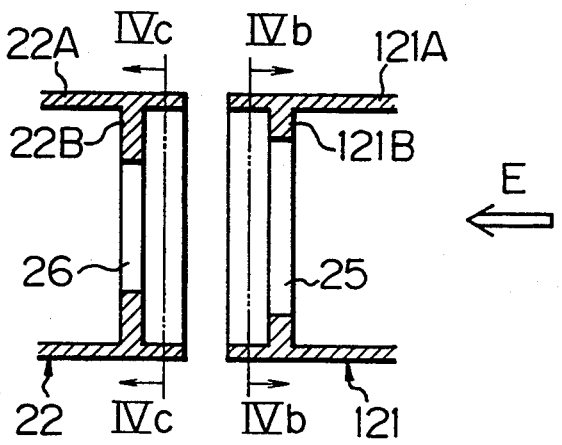
FIGS. 4*a* to 4*c* are structural sectional views showing the main electron lens portion of the in-line type electron gun assembly according to another embodiment of the present invention.
Figure 4B:
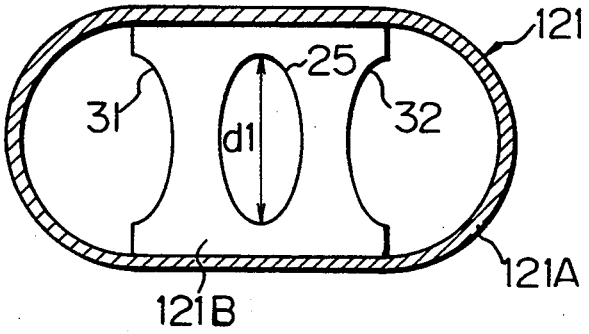
Figure 4C:
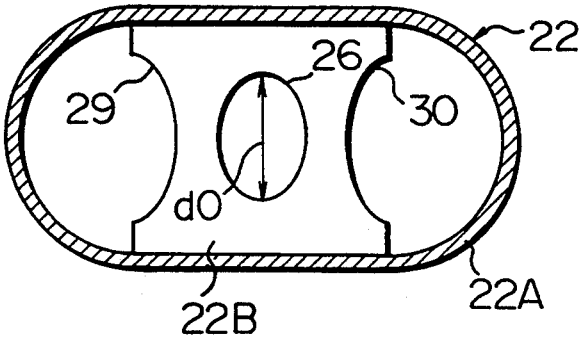

Next, FIG. 4*a* is a vertical longitudinal sectional view showing the structure/arrangement of the electrode units constituting the electron lens of the in-line type electron gun assembly according to another embodiment of the present invention, and FIG. 4*b* is a horizontal sectional view taken along a line IVb—IVb of FIG. 4*a* and shows the cross section of the aperture of the electrode unit 21 viewed in the horizontal direction. FIG. 4*c* is a structural sectional view showing the cross section of the aperture as viewed in the horizontal direction along a line IVc—IVc shown in FIG. 4*a*.

In FIG. 4*b*, reference numerals 31 and 32 denote the recessed edge portions such as the cutout portions that define the side electron beam passage holes of the plate member 121B of the G3 electrode unit 121 inclusive of the cylindrical member 121A, in cooperation with the inner wall of the cylindrical member 121A. Like reference numerals are used to identify like constituents as in FIGS. 3*a* to 3*d*. Symbol E represents the travelling direction of the electron beams, and the cathode unit, the G1 electrode unit and the G2 electrode unit are omitted from the drawing.

The side electron beam passage cutout portions 31, 32 of the plate member 121B have the shape defined by halving an ellipse in the vertical direction in the same way as the electron beam passage cutout portions 29, 30 of the plate member 22B of the G4 electrode unit 22 inclusive of the cylindrical member 22B.

When this embodiment is compared with the foregoing embodiment shown in FIGS. 3*a* to 3*d*, the side electron beam passage holes 27, 28 of the plate member 21B of the G3 electrode unit in the foregoing embodiment has the shape obtained by butting and connecting one semi-ellipse formed by halving an ellipse in the vertical dimension and a semi-circle having the same diameter as the vertical dimension, whereas in this embodiment, the cutout portions 31, 32 having the shape obtained by halving an ellipse in the direction of the major axis define the side electron beam passage holes in cooperation with the inner wall of the cylindrical member 121A. The rest of the construction are the same.

In this embodiment, the function the electron lens plays for the central electron beam is the same as the function the electron lens plays for the central electron beam in the foregoing embodiment. Therefore, the explanation in further detail will be omitted.

Figure 5A:
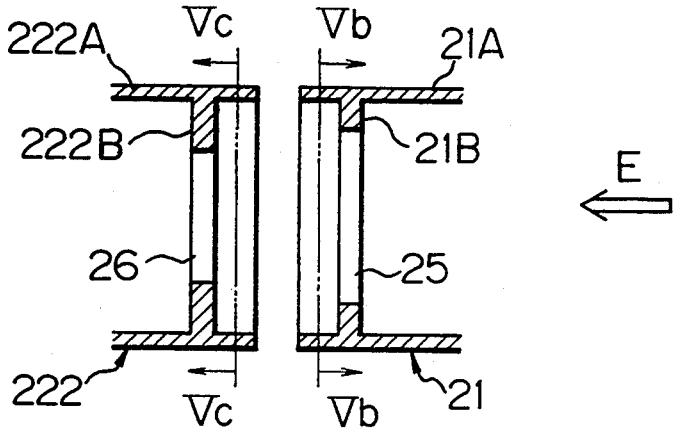
FIGS. 5*a* to 5*c* are structural sectional views showing the main electron lens portion of the in-line type electron gun assembly according to still another embodiment of the present invention.
Figure 5B:
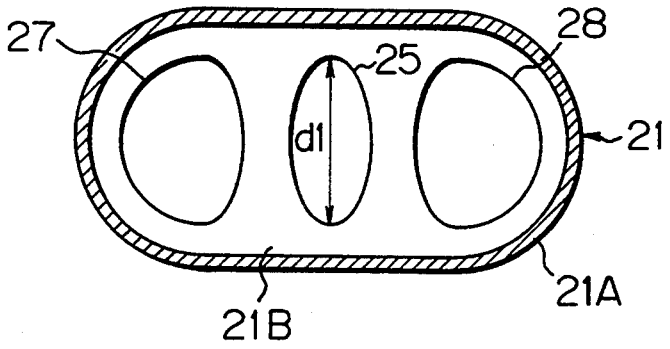
Figure 5C:
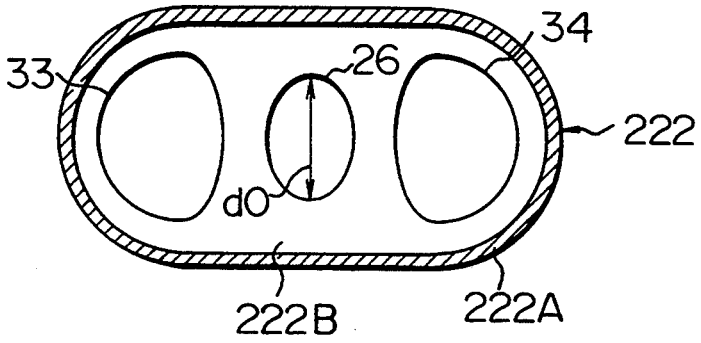

FIG. 5*a* is a vertical longitudinal sectional view showing the structure/arrangement of the electrode units forming the electron lens of the in-line type electron gun assembly according to another embodiment of the present invention, and FIG. 5*b* is a structural sectional view showing the cross section of the aperture when taken along a line Vb—Vb of FIG. 5*a* in the horizontal direction. FIG. 5*c* is a structural sectional view showing the cross section of the aperture when taken along a line Vc—Vc shown in FIG. 5*a* in the horizontal direction.

In FIG. 5*c*, reference numerals 33 and 34 denote the electron beam passage holes of the plate member 222B of the G4 electrode unit 222 inclusive of the cylindrical member 222A, and like reference numerals are used to identify other like constituents as in FIGS. 3*a* to 3*d*. Symbol E represents the travelling direction of the electron beams, and the cathode unit, the G1 electrode unit and the G2 electrode unit are omitted from the drawings.

The side electron beam passage holes 33, 34 of the plate member 222B has the shape obtained by butting and connecting one semi-ellipse halved in the direction of a vertical dimension and a semi-circle having the same diameter as the vertical dimension, in the same way as the side electron beam passage holes 27, 28 of the plate member 21B of the G3 electrode unit 21 inclusive of the cylindrical member 21A.

In the first embodiment, the recessed edge portions defining the side electron beam passage holes of the plate member 22B of the G4 electrode unit 22 are the cutout portions 29, 30 obtained by cutting and halving the ellipse in the direction of the vertical dimension. This embodiment is different from the first embodiment in that the former uses the electron beam passage holes 33, 34 having the shape obtained by butting and connecting a semi-ellipse cut and halved in the direction of the vertical dimension and a semicircle having the same diameter as the vertical dimension, but the rest of the construction are the same.

In this embodiment, too, the function the electron lens plays for the central electron beam is the same as the function the electron lens plays on the central electron beam in the first embodiment. Therefore, the explanation in further detail will be omitted.

According to the three embodiments described above, the expansion of the spot shape in the horizontal direction on the phosphor screen for the central electron beam can be prevented by the use of the cylindrical G3 electrode units 21, 121, 21 and the G4 electrode units 22, 22, 222 having the substantially elliptic cross section having their major axes in the direction of the arrangement of three electron beams. Moreover, the impingement of the electron beams against the plate members 21B, 121B, 21B of the G3 electrode units can be prevented, because it is no longer necessary to decrease the horizontal direction diameter of the central electron beam passage holes in the plate members of the G3 electrode unit for the purpose of increasing the ratio of the vertical direction diameter to the horizontal direction diameter of the central electron beam passage holes in those plate members. For example, with a color cathode-ray tube having an in-line type electron gun assembly including the electrode units of the sizes shown in FIGS. 3*b* and 3*c*, it has been found that when the horizontal direction diameter of the center beam passage hole 25 in the G3 electrode unit 21 is smaller than 4.0 mm, the center beam will impinge on the plate member 21B of the G3 electrode unit 21. However, according to the described embodiment, the horizontal direction diameter of the center beam passage hole 25 in the G3 electrode 21 is $2.12\times2=4.24$ mm to attain the intended focusing effect and need not be decreased to 4.0 mm or smaller, as described above with reference to FIG. 6.

Each of the embodiments given above deals with the case where the central electron beam incident into the electron lens expands in the horizontal direction. When the central electron beam incident into the electron lens expands in the vertical direction due to the arrangement and structures of the pre-stage electrode units such as the G1 electrode unit and the G2 electrode unit, the expansion of the spot shape on the phosphor screen obtained by the central electron beam can be prevented in advance in the same way as each of the foregoing embodiments by constituting the vertical dimension d1 of the central electron beam passage hole 25 of the plate member 21B, 121B, 21B of the G3 electrode unit and the vertical dimension d0 of the central electron beam passage hole of the plate member 22B, 22B, 222B of the G4 electrode unit in such a manner as to satisfy the relation $d1<d0$.

Though the shape of the electron beam passage holes in the foregoing embodiments are elliptic, other shapes such as the one obtained by connecting a semicircle to both ends of two parallel lines can also be employed in the present invention. Other examples of the shape of the electron beam passage holes are: non-rotational symmetry shapes vertically elongated such as flattened circular shapes, rectangular shapes, hexagonal shapes, etc. elongated vertically.

Though the major axis of the electron beam passage holes exists in the vertical direction, the beam passage holes having the major axis thereof in the horizontal direction are sometimes suitable depending on the positions of the arrangement of the plate members of the G3 and G4 electrode units, or on the shape of the apertures of these electrode units.

As described above, the non-circular central electron beams disposed in the plate members of the electrode units on the low and high potential sides constituting the electron lens, respectively, have mutually different dimensions of the major axes. Accordingly, the focusing effects of the central electron beam in the vertical direction can be corrected appropriately in the electron lens, and can be made substantially equal to the focusing effects in the horizontal direction, so that the spot shape on the phosphor surface obtained by the central electron beam can be made substantially circular.

Furthermore, since the spot shape on the phosphor screen obtained by the central electron beam becomes substantially circular, astigmatism of the central electron beam can be eliminated and resolution of the image can be improved.

We claim:

1. An in-line electron gun assembly, comprising:

a cathode unit for producing a central electron beam and two side electron beams; and first and second electrode units which are to be held at first and second voltages in operation and through which said electron beams are to pass, each of said first and second electrode units having a cylindrical member of a non-circular elongated cross section and a plate member provided on an inner wall of said cylindrical member so as to be joined therewith to define electron beam passage holes juxtaposed, within said cylindrical member, in a lengthwise direction of said non-circular elongated cross section of said cylindrical member, said plate member of each of said first and second electrode units having at least one hole therein serving as an electron passage hole for said central electron beam, said second electrode unit being downstream of said first electrode unit with respect to the electron beams, in which said second voltage is higher than said first voltage so that said first and second electrode units cooperate to form a main electrostatic lens having a combination of a first function of said first electrode unit of causing said electron beams to focus and a second function of said second electrode unit of causing said electron beams to diverge, and a diameter of the hole in the plate member of one of said first and second electrode units measured in a direction substantially perpendicular to said lengthwise direction of said non-circular elongated cross section of the cylindrical member of said one electrode unit is different from a diameter of a corresponding hole in the plate member of the other electrode unit measured in a direction substantially perpendicular to said lengthwise direction of said non-circular elongated cross section of said cylindrical members to an extent such that one of said first and second functions is emphasized as compared with the other function in a direction substantially perpendicular to said lengthwise direction of said non-circular elongated cross section of said cylindrical members.

2. An in-line electron gun assembly according to claim 1, in which the diameter of the hole in the plate member of said first electrode unit is larger than the diameter of the hole in the corresponding plate member of said second electrode unit for emphasizing said second function as compared with said first function in said direction substantially perpendicular to said lengthwise direction of said non-circular elongated cross section of said cylindrical members.

3. A color cathode-ray tube including an in-line electron gun assembly as defined in claim 2.

4. A color cathode-ray tube including an in-line electron gun assembly as defined in claim 1.

5. A color cathode-ray tube according to claim 4, wherein said first and second electrode units are configured so as to at least optimize said central electron beam shape.

6. A color cathode-ray tube according to claim 4, wherein said first and second electrode units are configured so as to provide a substantially circular central electron beam shape.

7. An in-line electron gun assembly according to claim 1, wherein said first and second electrode units are configured so as to at least optimize said central electron beam shape.

8. An in-line electron gun assembly according to claim 1, wherein said first and second electrode units are configured so as to provide a substantially circular central electron beam shape.

9. An in-line electron gun assembly, comprising:

a cathode unit for producing a central electron beam and two side electron beams;

a first electrode unit through which the three electron beams from said cathode unit pass, said first electrode unit being held at a first voltage in operation, said first electrode unit having a first cylindrical member of a non-circular elongated cross section and a first plate member provided on an inner wall of said first cylindrical member so as to be joined therewith to define electron beam passage holes juxtaposed, within said first cylindrical member, in a direction parallel with a long diameter of said non-circular elongated cross section of said first cylindrical member, said first plate member having at least one non-circular elongated hole therein serving as an electron passage hole for said central beam, said non-circular elongated hole having its short diameter substantially parallel with said long diameter of said non-circular elongated cross section of said first cylindrical member; and a second electrode unit through which the three electron beams coming from said first electrode unit pass, said second electrode unit being held at a second voltage in operation, said second electrode unit having a second cylindrical member of a non-circular elongated cross section and a second plate member provided on an inner wall of said second cylindrical member so as to be joined therewith to define electron beam passage holes juxtaposed, within said second cylindrical member,in a direction parallel with a long diameter of said non-circular elongated cross section of said second cylindrical member, said second plate member having at least one hole therein serving as an electron passage hole for said central beam, said second voltage is higher than said first voltage so that said first and second electrode units cooperate to form a main electrostatic lens having a combination of a first function of said first electrode unit of causing said electron beams to focus and a second function of said second electrode unit of causing said electron beams to diverge, in which a diameter of said hole in said first plate member measured in a direction substantially perpendicular to said long diameter of said non-circular elongated cross section of said first cylindrical member is larger than a diameter of a corresponding hole in said second plate member measured in a direction substantially perpendicular to said long diameter of said non-circular elongated cross section of said second cylindrical member for emphasizing said second function in said direction substantially perpendicular to said long diameter of said non-circular elongated cross section of said second cylindrical member as compared with said first function in said direction substantially perpendicular to said long axis of said non-circular elongated cross section of said first cylindrical member.

10. An in-line electron gun assembly according to claim 9, in which said first plate member is non-circular elongated and has three non-circular elongated holes therein juxtaposed in a direction parallel with a long diameter of said first non-circular elongated plate member each of said holes having its short diameter substantially parallel with said long diameter of said first non-circular elongated plate member, and said second plate member has one hole therein serving as said electron passage hole for said central beam and has recessed opposite edge portions for defining, with said inner wall of said second cylindrical member, two electron beam passage holes for said two side electron beams.

11. A color cathode-ray tube including an in-line electron gun assembly as defined in claim 10.

12. An in-line electron gun assembly according to claim 9, in which each of said first and second plate members is non-circular elongated and has three non-circular elongated holes therein juxtaposed in a direction substantially parallel with a long diameter of its associated non-circular elongated plate member, each of said holes having its short diameter substantially parallel with said long diameter of its associated non-circular elongated plate member.

13. A color cathode-ray tube including an in-line electron gun assembly as defined in claim 12.

14. An in-line electron gun assembly according to claim 9, in which each of said first and second plate members has one hole therein serving as said electron passage hole for said central beam and has recessed opposite edge portions for defining, with said inner wall of its associated cylindrical member, two electron beam passage holes for said two side electron beams.

15. A color cathode-ray tube including an in-line electron gun assembly as defined in claim 14.

16. A color cathode ray tube including an in-line electron gun assembly as defined in claim 9.

* * * * *